US012109456B2

(12) United States Patent
Gilstrom et al.

(10) Patent No.: US 12,109,456 B2
(45) **Date of Patent: *Oct. 8, 2024**

(54) MODULAR EXERCISE MACHINE

(71) Applicant: Tonal Systems, Inc., San Francisco, CA (US)

(72) Inventors: Lars Eugene Gilstrom, Berkeley, CA (US); Justin Ziccardi, San Francisco, CA (US); David Mallard, Mill Valley, CA (US)

(73) Assignee: Tonal Systems, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/369,059

(22) Filed: Sep. 15, 2023

(65) Prior Publication Data

US 2024/0001197 A1 Jan. 4, 2024

Related U.S. Application Data

(63) Continuation of application No. 16/672,322, filed on Nov. 1, 2019, now Pat. No. 11,819,736.

(51) Int. Cl.
*A63B 22/06* (2006.01)
*A63B 21/00* (2006.01)
(Continued)

(52) U.S. Cl.
CPC ..... *A63B 24/0062* (2013.01); *A63B 21/4027* (2015.10); *A63B 22/0605* (2013.01);
(Continued)

(58) Field of Classification Search
CPC . A63B 24/00; A63B 24/0006; A63B 24/0009; A63B 24/0062; A63B 24/0075; A63B 24/0084; A63B 24/0087; A63B 2024/0065; A63B 2024/0068; A63B 2024/0071; A63B 2024/0078; A63B 2024/0081; A63B 2024/009; A63B 2024/0093; A63B 2024/0096;
(Continued)

(56) References Cited

U.S. PATENT DOCUMENTS 4,627,617 A 12/1986 Gilmore
5,318,491 A 6/1994 Houston
(Continued)

FOREIGN PATENT DOCUMENTS

CN 203520652 4/2014

*Primary Examiner* — Zachary T Moore
(74) *Attorney, Agent, or Firm* — Van Pelt, Yi & James LLP

(57) ABSTRACT

An exercise machine includes a first housing, a central electromagnetic resistance unit, a resistance mechanical interface, and a mechanical expansion portion. The resistance mechanical interface includes a spool and a cable configured to provide a force from the central electromagnetic resistance unit in response to a control interface that receives commands from an exercise actuator. The cable extends out from a first side of the first housing. The mechanical expansion port is configured to link the first housing to a second housing via a mechanical attachment. The mechanical expansion port is located at a second side of the first housing. The second side of the first housing is adjacent to the first side of the first housing.

20 Claims, 14 Drawing Sheets

(51) Int. Cl.
*A63B 21/005* (2006.01)
*A63B 24/00* (2006.01)
*A63B 71/06* (2006.01)

(52) U.S. Cl.
CPC .... *A63B 71/0622* (2013.01); *A63B 21/00058* (2013.01); *A63B 21/005* (2013.01)

(58) Field of Classification Search
CPC ..... A63B 21/005; A63B 21/0051; A63B 21/0052; A63B 21/0053; A63B 21/0056; A63B 21/0057; A63B 21/0058; A63B 21/0059; A63B 21/00058; A63B 21/00069; A63B 21/00076
See application file for complete search history.

(56) References Cited

U.S. PATENT DOCUMENTS 6,450,922 B1 9/2002 Henderson
6,620,043 B1 9/2003 Haseltine
6,902,513 B1 6/2005 McClure
6,921,351 B1 7/2005 Hickman
8,517,899 B2 8/2013 Zhou
8,911,330 B2 12/2014 Watterson
10,471,297 B1 11/2019 Smith
2002/0025891 A1* 2/2002 Colosky, Jr. ..... A63B 23/00 482/127
2003/0134714 A1 7/2003 Oishi
2003/0171190 A1 9/2003 Rice
2009/0018795 A1 1/2009 Priester
2010/0125026 A1 5/2010 Zavadsky
2010/0148943 A1 6/2010 Rosenberg
2011/0251021 A1* 10/2011 Zavadsky ..... A63F 13/28 482/5
2012/0108394 A1 5/2012 Jones
2013/0026322 A1 1/2013 Wheeler
2014/0038777 A1* 2/2014 Bird ..... A63B 23/03525 482/5
2014/0038781 A1 2/2014 Paul
2014/0194250 A1 7/2014 Reich
2015/0343290 A1 12/2015 Freiberg
2015/0360083 A1 12/2015 Lagree
2016/0067548 A1 3/2016 Shiao
2016/0074697 A1 3/2016 Clarke
2018/0021616 A1* 1/2018 Orady ..... A63B 24/0087 482/5
2018/0099178 A1 4/2018 Schaefer
2018/0111034 A1* 4/2018 Watterson ..... A63B 22/0605
2019/0099632 A1 4/2019 Orady
2019/0099637 A1* 4/2019 Valente ..... A63B 21/4047
2019/0351283 A1 11/2019 Smith
2020/0047027 A1 2/2020 Ward
2020/0047030 A1 2/2020 Ward
2020/0047053 A1 2/2020 Ward
2020/0047054 A1 2/2020 Ward
2020/0047055 A1 2/2020 Ward
2020/0054929 A1 2/2020 Ward
2020/0078635 A1 3/2020 Smith
2021/0111646 A1* 4/2021 Rubin ..... A63B 22/02

* cited by examiner

MODULAR EXERCISE MACHINE

CROSS REFERENCE TO OTHER APPLICATIONS

This application is a continuation of U.S. patent application Ser. No. 16/672,322 entitled MODULAR EXERCISE MACHINE filed Nov. 1, 2019 which is incorporated herein by reference for all purposes.

BACKGROUND OF THE INVENTION

Strength training, also referred to as resistance training or weight lifting, is an important part of any exercise routine. It promotes the building of muscle, the burning of fat, and improvement of a number of metabolic factors including insulin sensitivity and lipid levels. Many users seek a more efficient and safe method of strength training at home or away from home that integrates well into their lifestyle.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention.

Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A modular exercise machine module is disclosed for strength training that includes an electric motor, a cable, and firmware for motor control and workout management. This disclosed module is a component for a weight stack replacement for OEMs and/or incorporated into a DIY frame or attachment.

A slim wall-hanging exercise machine platform is disclosed that may serve multiple functions: modern strength training, modern cardiovascular exercise, gaming, wall hanging mirror, television screen, web browser, and home automation center. The platform may include one or more modular exercise machine modules.

Figure 1:
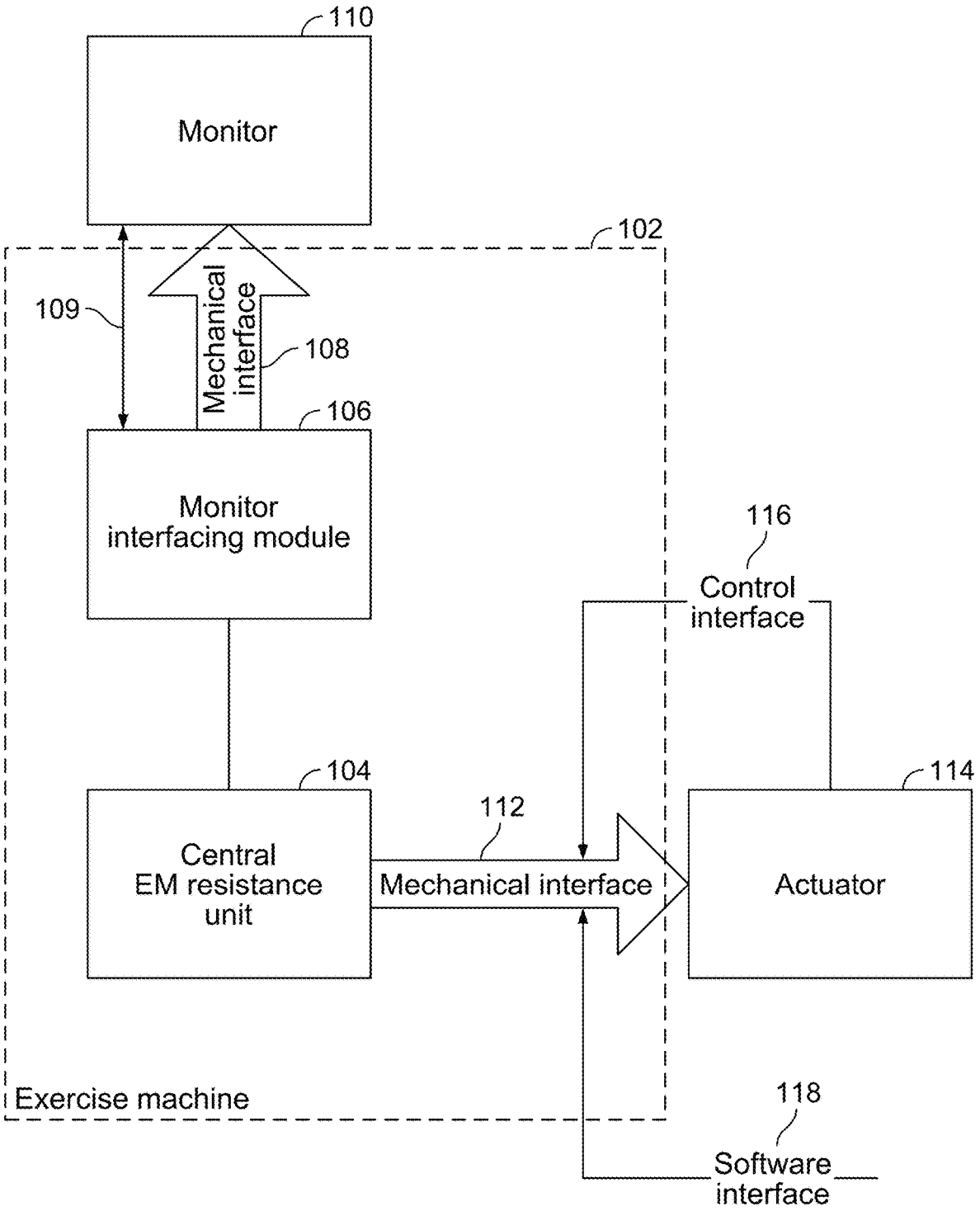
FIG. 1 is a block diagram illustrating an embodiment of a system for a slim wall-hanging exercise machine platform.

FIG. 1 is a block diagram illustrating an embodiment of a system for a slim wall-hanging exercise machine platform. The platform includes exercise machine (102) comprising a central electromagnetic (EM) resistance unit (104), for example a modular exercise machine module, coupled to a monitor interfacing module (106). A monitor (110) is coupled to this monitor interface module (106) and/or exercise machine (102) via at least two interfaces: a monitor mechanical interface (108) to support the monitor (110), and a monitor interface (109) that can accommodate a standard video connection to the monitor (110).

A resistance mechanical interface (112) is configured to provide a force from the central EM resistance unit (104) to an exercise actuator (114), in response to a control interface (116) that receives commands from the exercise actuator (114); and a software interface (118) that receives collaborative information about an exercise session.

Figure 2A:
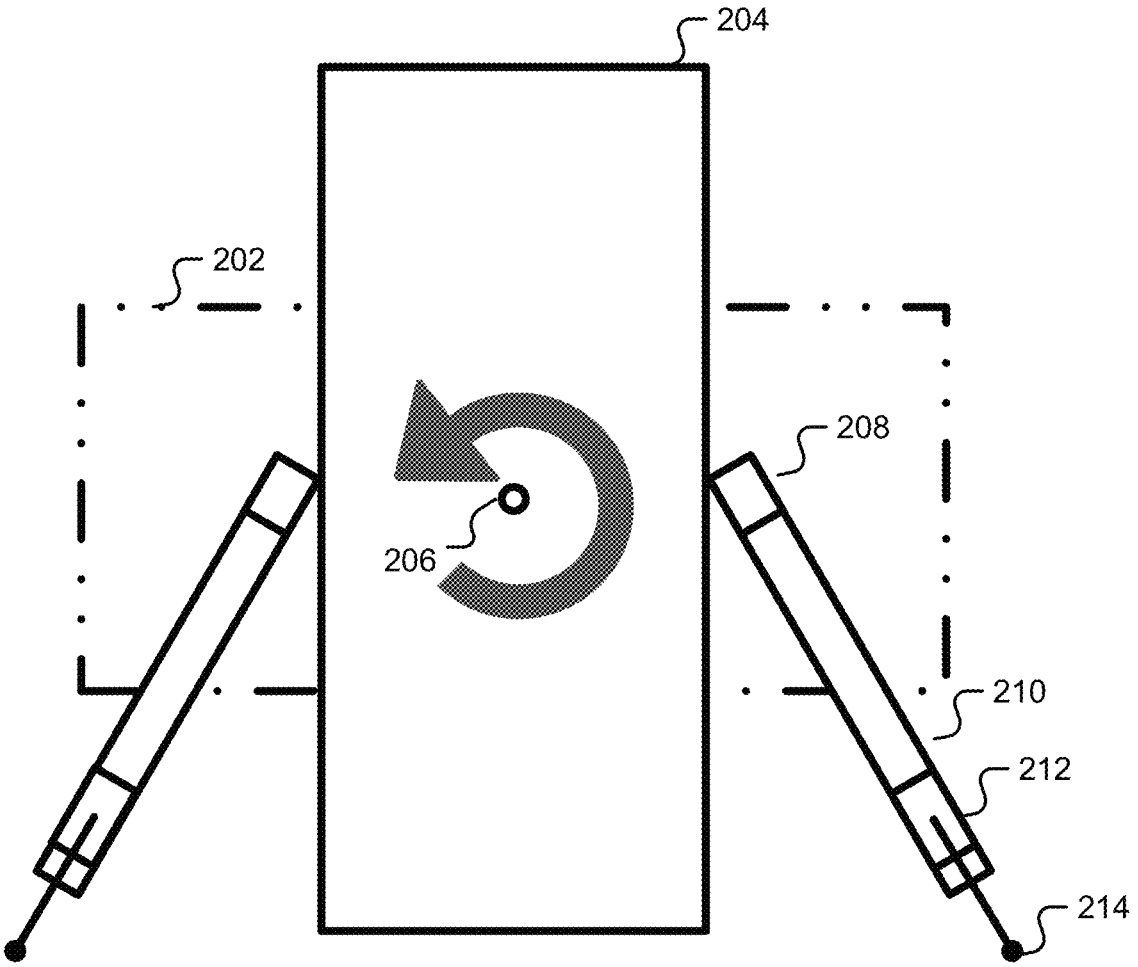
FIG. 2A is an illustration of the slim wall-hanging exercise machine platform deployed on a wall for exercise.

FIG. 2A is an illustration of the slim wall-hanging exercise machine platform deployed on a wall for exercise. The illustration in FIG. 2A is based on a front projection, looking towards the wall from in front of the machine. A wall mount (202), shown in a dash-dot line to indicate the mount may be inset into a typical wall, in a landscape orientation allows the monitor (204) to rotate around a monitor axis point (206) to orient the monitor (204) in a portrait orientation. All or parts of the mount (202) may be installed into a wall to make the system as compact as possible, as it may be mounted between studs, or within a masonry wall by removing material to fit the system.

One or more arms (210) are rotated around an arm axis point (208) and provide a way to set an origination point for the exercise actuator (214) by way of pivoting (208) and sliding along a carriage (212). Arms may be round, square, or any shape depending on requirements. Telescoping allows the device to be stored in a smaller area, and to enable a columnless exercise system.

Pivoting is done for example with a simple ball or rotating joint (206) and a locking mechanism. Depending on the model and/or trim level, pivoting may be balanced for easy manual operation by the user or it may be automated to a single button press with robotics. Depending on user features and/or model, the pivot mechanism may pivot the screen only or the entire exercise machine. The deluxe model of pivot mechanism also includes angulation control left/right/up/down to improve viewing angle depending on the location of the user. Sensors may be configured to detect the position and/or orientation of the screen such that the appropriate mode is enabled.

An Android or other control board includes an accelerometer to determine whether the display (204) is in portrait or landscape orientation. In portrait orientation, the system may be in mirror or exercising training mode. In landscape orientation, the screen may default to monitor mode for connection to other video sources such as broadcast TV using a tuner, a PC, gaming console, and/or set top box.

In the portrait orientation the arms (210) may remain stowed and the monitor (204) may function as a mirror or smart mirror. For example, a reflective surface such as a two-way mirror glass, may be used to provide smart mirror functionality with a video substrate below the reflective surface/film to project information onto the mirror. In one embodiment, smart glass or switchable is used wherein light transmission properties are changed electronically.

In one embodiment, the screen (204) material is a partially transmissive reflective surface. The screen material may be Non-conductive vacuum metalizing (NCVM) or other conductive material deposited directly on the screen or may be a film which has the reflective material deposited on thin plastic sheets. Different applications and/or models of the screen (204) may vary the screen reflectivity. The higher the reflective the screen, the higher the light output from the video display is required to overcome the reflections coming from the environment. Lower reflective material allows the screen and other hardware to be seen behind the reflective screen.

Figure 2B:
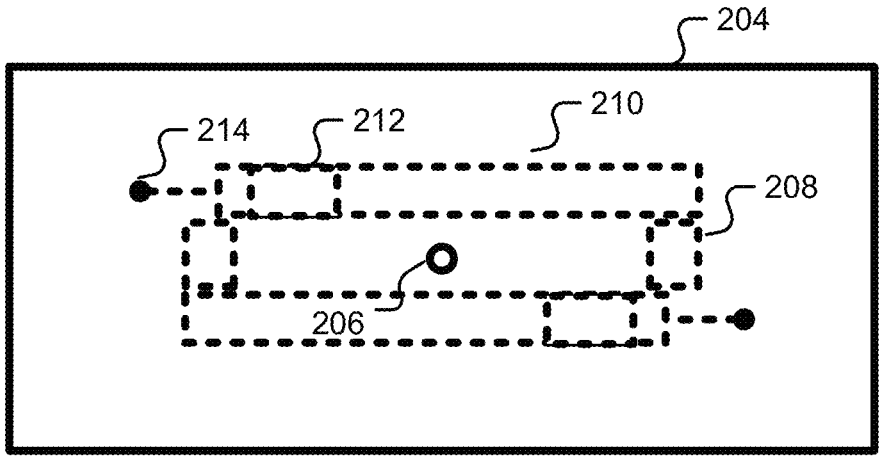
FIG. 2B is an illustration of the slim wall-hanging exercise machine platform stowed.

FIG. 2B is an illustration of the slim wall-hanging exercise machine platform stowed. The illustration in FIG. 2B is based on a front projection, looking towards the wall from in front of the machine. The monitor (204) is pivoted (206) in a landscape orientation, for example to permit viewing of a movie or television in a traditional orientation. Dotted lines in FIG. 2B are shown to denote objects that are behind other objects, for example arms (210), carriage (212) and exercise actuator (214). The pivot (208) is shown to include an elbow joint to allow the arms to tuck neatly and/or compactly behind screen (204).

The exercise system may be hidden by landscape orientation as shown in FIG. 2B. Arms may use robotics to move arms out of a compact stow position. A remote control may be used to automate the switch from landscape to portrait orientation and move the arms out of stow. This system uses a single pivot point (208) on the right and left of the portrait orientation display and the arms telescope into position based on the starting exercise.

Figure 2C:
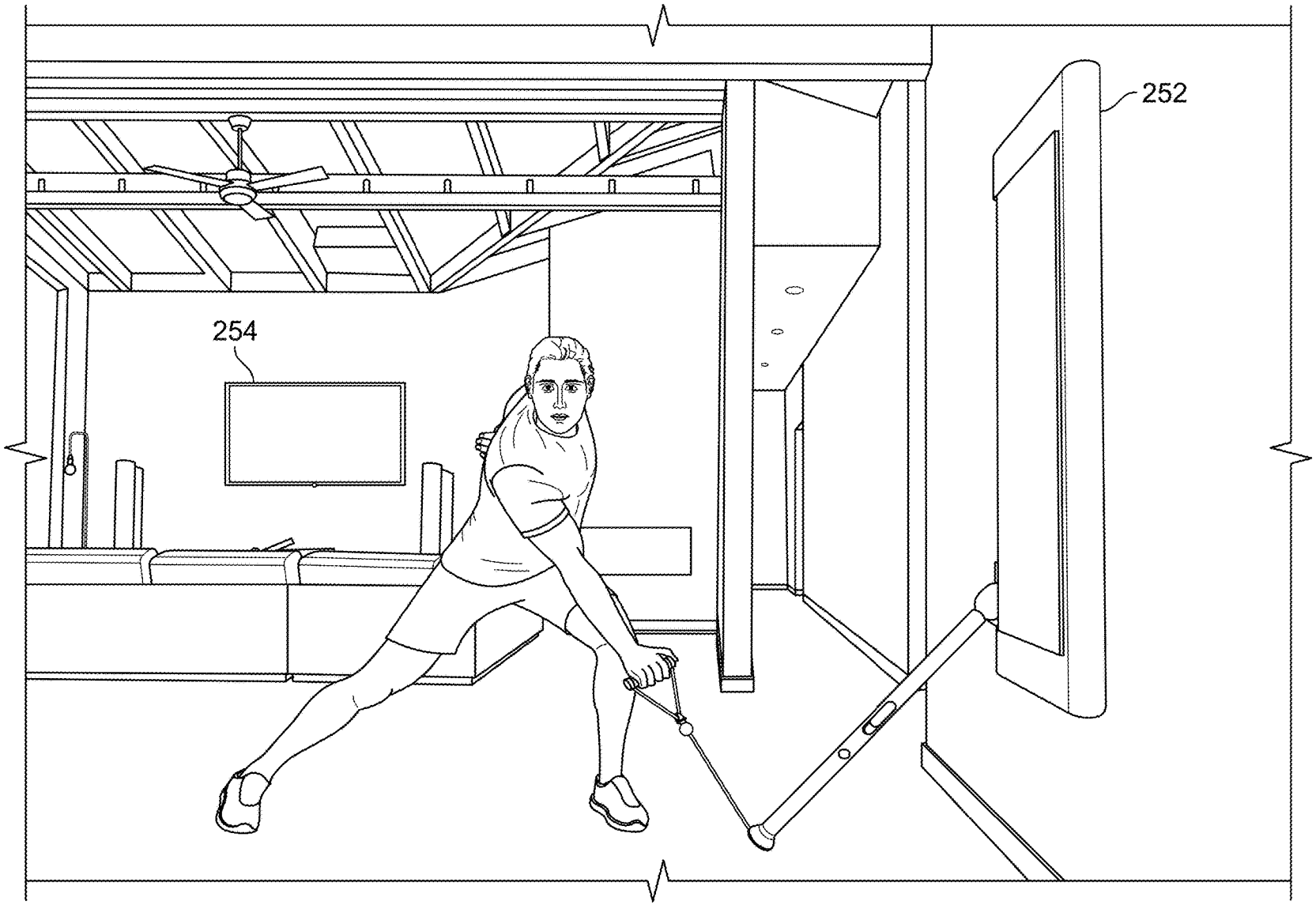
FIG. 2C is an illustration of two slim wall-hanging exercise machine platforms in a sample use.

FIG. 2C is an illustration of two slim wall-hanging exercise machine platforms in a sample use. A user is using one slim wall-hanging exercise machine (252) in a portrait orientation for a pull-up exercise with the video on the monitor coaching the user. A second slim wall-hanging exercise machine (254) is used for watching movies in a landscape orientation.

Elements for a slim wall-hanging exercise machine platform include at least one of the following:

- Widgets connected to the motors enabling slow strength training, and fast cardiovascular exercise;
- Firmware enabling AI coaching of exercises displayed on the monitor (204) and output on monitor speakers or other speakers/headsets;
- Devices and firmware enabling gaming;
- A screen (204) made of material that serves as a mirror when unpowered, and as a touch screen capable of Internet apps and browsing when powered;
- Integration with a photo server or photo web service to allow the screen (204) to function as a photo album when powered;
- A television module enabling the screen (204) to serve as a television;
- Integration with video download or video streaming services to allow the screen (204) to serve as a television or set-top box;
- A terrestrial or satellite radio module and integration with audio streaming services to allow the trainer to serve as an audio/music/news center;
- Hardware (206) enabling the screen to pivot to landscape orientation for TV watching;
- Additional screen to allow simulcasting for a better viewing angle or secondary screens to allow seeing coaches from a different viewing angle to better understand their workout form or to permit a user to see themselves from a different angle to understand their own form, even providing an overlay/comparison of the two; and
- Home automation via voice command.

Multiple views and/or multiple screen are used to improve the experience at certain trim levels of the system. From a content perspective, multiple point of view omni-directional filming from drones is an efficient way to describe human motion with many degrees of freedom. Viewers of this content may interact with it and choose the POV they are interested in seeing one or more times and in different perspective views. A user chooses to see the fitness model from any angle or from multiple angles simultaneously to get a better sense of the exercise they should be doing.

Multiple cameras in the disclosed machine or connected wirelessly in the room allows the artificial intelligence (AI) trainer depicted on the monitor (110) to have a better view of the user and provide better form detection. It is possible to visually overlay the user with a model of the perfect form and show areas of improvement or even show the user along side the fitness model or another user. The user is able to select the preferred viewing angle as there are multiple cameras.

There are many uses for multiple screens in an exercise system. As a user moves through an exercise or does different exercises their position changes and in many positions it may be easier to look at a different screen. As well, as the user is looking at a different screen they may want to see a different point of view to better explain what is happening. In one embodiment, augmented reality and/or virtual reality glasses (110) are used to provide an immersive screen experience.

Another use of multiple screens is having other places to control the trainer from, for example the control may be from a wearable like a watch or headset, or from a phone. In a group class or gaming situation one of the plurality of screens is used for gaming stats, or to watch the coach or to watch what others are doing.

The platform can provide one or more recreational applications, for example:

Home strength training, with an AI coach;

Server based motors for a strength training meets gaming application;

Web connected home exercise bike;

Wall hanging mirror that doubles as a Skype/Facetime screen; and

A small, portable compact strength training machine.

As referred to herein, a "wall-hanging" machine is a machine that either hangs on a wall, is mounted on a stand, for example at a convenient height for sitting and/or standing, or is mounted in any way a traditional television or gaming device would be mounted. A wall-hanging exercise machine is disclosed that is a universal or "ultimate" home exercise machine any user needs—and serves as a wall hanging mirror, gaming portal, television screen, and home automation center.

Gaming input devices including game controllers, keyboards, and other hand-held controllers such as VR controllers may be used in the machine in FIG. 1. The controllers and keyboards may be connected via cables such as USB, or via wireless such as Bluetooth and Wifi.

Game consoles are connected directly via interfaces like HDMI and USB, or via wireless. This enables a game console to use the exercise machine display for standard games and to communicate with the exercise machine for exercise enabled games. Game applications may be loaded onto an Android or other enabled video controller board which controls the operation and UX of the system.

A microphone system for voice commands may include multiple microphones to enable beamforming, far field control, and noise cancelling. In some cases the user environment may be quiet but for greater customer reliability this type of microphone supports noisy environments and cancels out any exercise equipment noise.

Voice commands are received via microphone and electrically transmitted to the system to either process the audio information locally to get text data/voice information within the system, or be compressed and sent to the cloud for processing to get text based data back. The data may then be used to stow or unstow the system, or control things like audio level, screen brightness, music level, rack or unracking weights, starting/ending exercise, and/or joining friend for exercise. It may also control much of the user's environment.

The machine shown in FIGS. 2A, 2B, and 2C may be cable based which is primarily linear motion based. There are some types of cardio that are mainly linear with a limited stroke length like rowing, cross country skiing, elliptical trainer, stair climber.

Others types of cardio are mainly rotational like cycling, upper body cycling or a treadmill. The disclosed machine may be applied to rotational exercise such as these. Coupling linear motion that has a limited distance by the length of the cable to a continuous rotational motion is implemented in one of two ways.

First, one of the motors has a cable disconnected and a continuously rotating shaft is the interface instead of a cable on a spool. A continuously rotating shaft may easily connect directly or via a belt or chain to a cardio accessory such as a bicycle or treadmill.

Figure 3A:
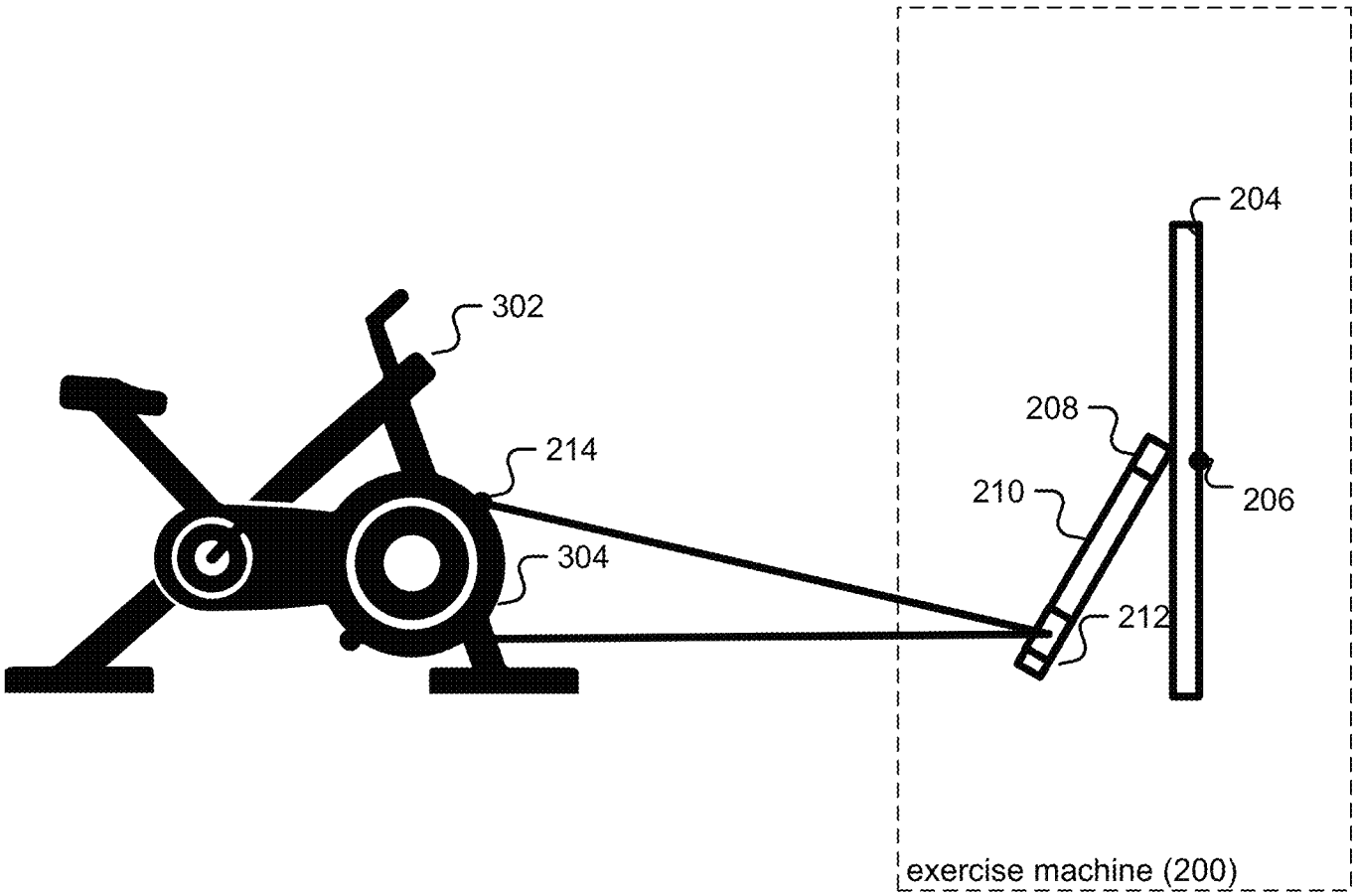
FIG. 3A is an illustration of the use of the slim wall-hanging exercise machine platform in use with a bicycle application on a front wheel.
Figure 3B:
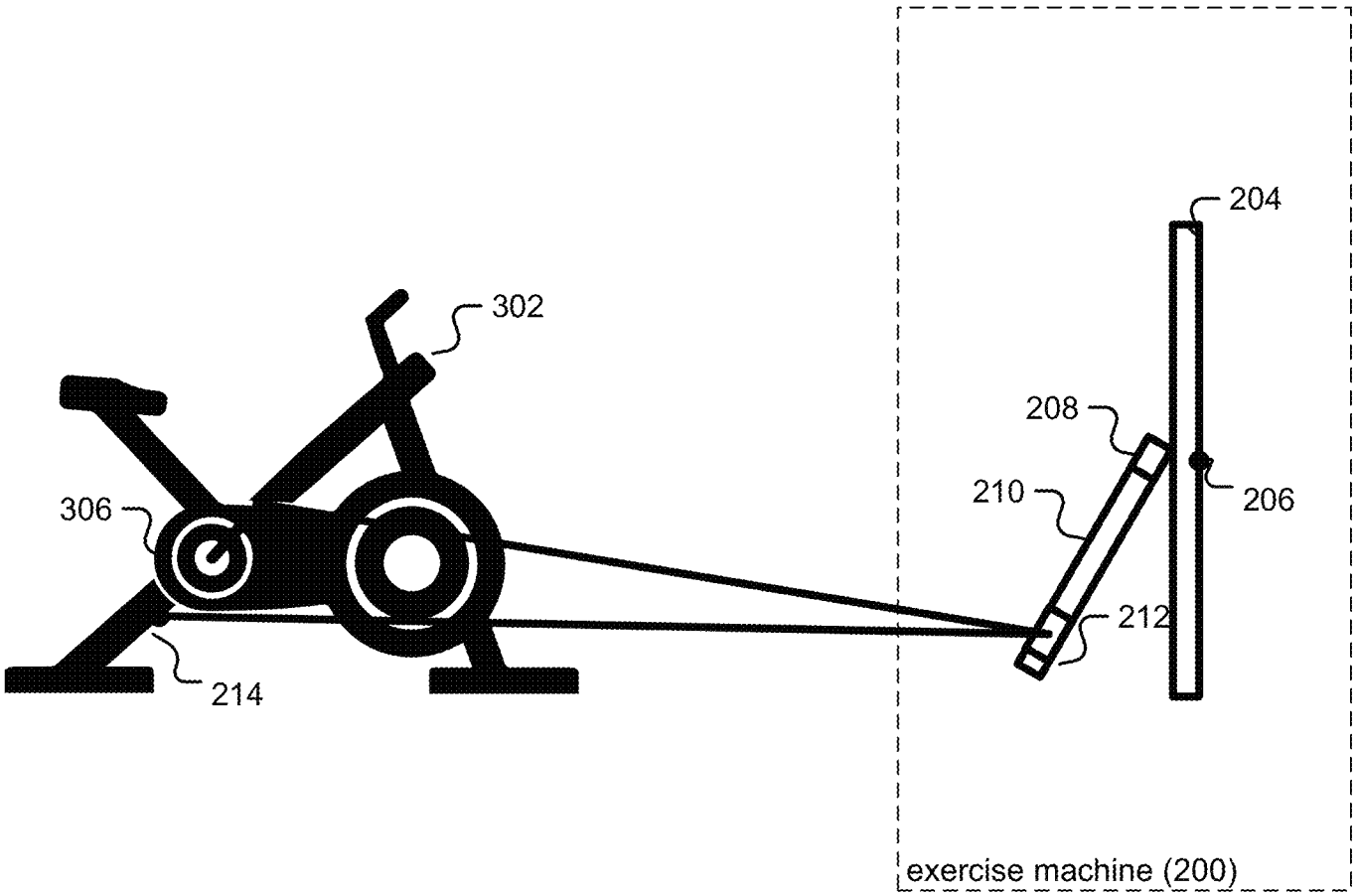
FIG. 3B is an illustration of the use of the slim wall-hanging exercise machine platform in use with a bicycle application on a pedal set.

Second, using two motors in a push pull configuration or a single motor with a crank slider enables using existing cables and connecting them to a rotational cardio accessory like a bicycle or treadmill as shown in FIGS. 3A and 3B.

FIG. 3A is an illustration of the use of the slim wall-hanging exercise machine platform in use with a bicycle application on a front wheel. Exercise bike (302) is placed such that an actuator (214) from an arm is at a point on the front wheel (304) of the exercise bike. As shown in FIG. 3A, there may be two arms (210) for the machine (200) so that the actuators (214) are at opposite points on the front wheel (304).

The exercise bike (302) is an example of a cardiovascular exercise use of the exercise machine (200) as opposed to a strength training use of the machine (200), wherein an actuator (214) may be connected for example to a handle for curlups or pulldowns, for example.

FIG. 3B is an illustration of the use of the slim wall-hanging exercise machine platform in use with a bicycle application on a pedal set. Exercise bike (302) is placed such that an actuator (214) from an arm is at a point on a pedal (306) of the exercise bike. As shown in FIG. 3B, there may be two arms (210) for the machine (200) so that the actuators (214) are at opposite pedals (306).

In motor mechanics there is a tradeoff between speed and force. This is true in many machines, for a bicycle this is managed by the gearing system. If a specific force or speed combination is required for strength trainer or fast cardio then a gearing system to increase or decrease mechanical advantage can be added to provide extra speed at the expense of force or extra force at the expense of speed.

Figure 4A:
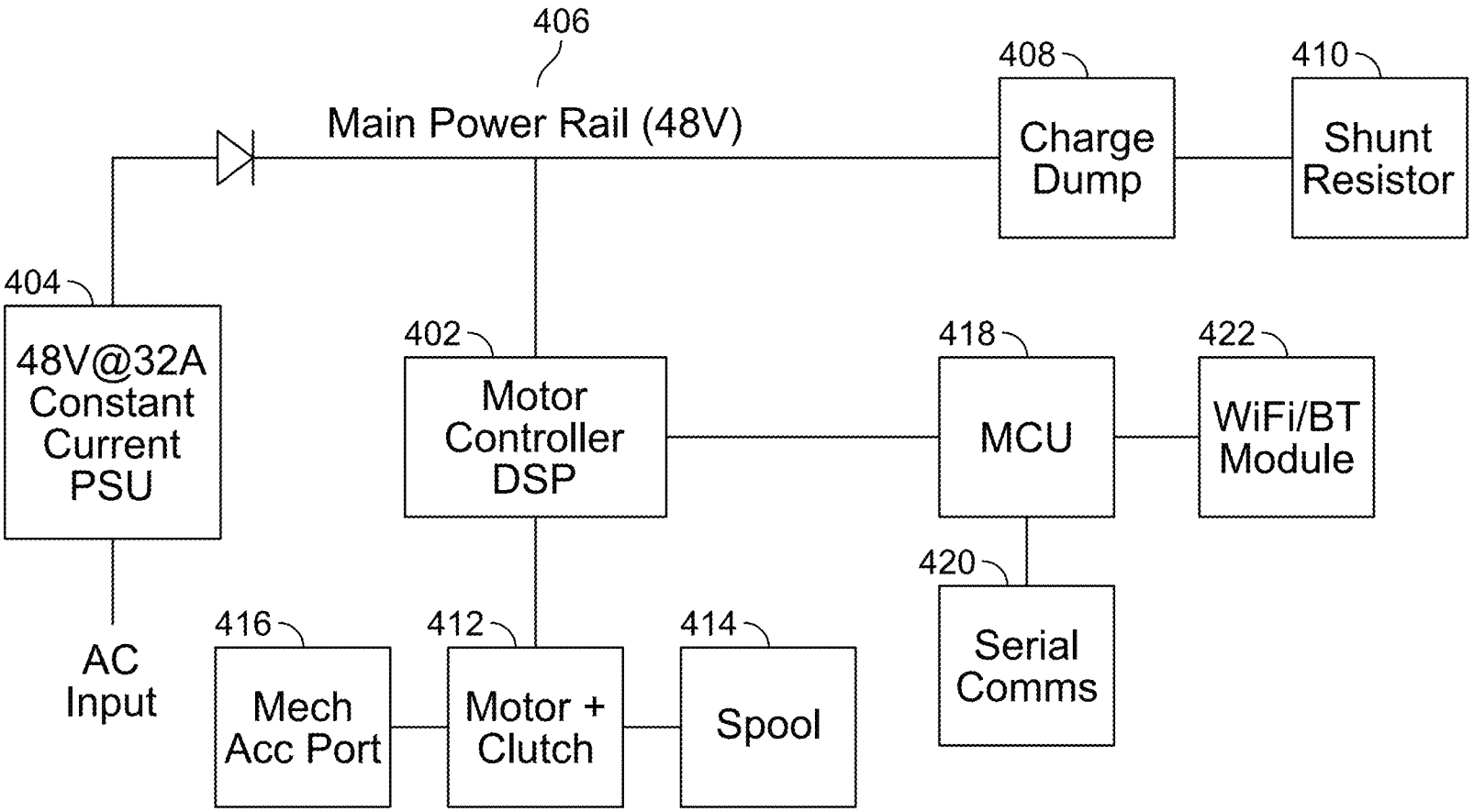
FIG. 4A is a block diagram illustrating a system for a modular exercise module.

FIG. 4A is a block diagram illustrating a system for a modular exercise module. In one embodiment, the central EM resistance unit of FIG. 4A is the unit (104) in FIG. 1.

A 48V power supply unit (404) power a main rail (406) to power a motor controller DSP (402) coupled to a microcontroller unit (418) with optional serial communications device (420) and/or Wi-Fi/Bluetooth module (422). The motor controller DSP (402) is coupled to a motor/clutch assembly (412). In one embodiment, two pancake motors are used for the assembly (412). The motor/clutch assembly (412) is coupled to a spool (414) that may be coupled to an exercise actuator (114) as shown via mechanical interface (112) in FIG. 1. The motor/clutch assembly (412) may also or instead be coupled to a mechanical accessory/expansion port (416) in order to assemble multiple modular modules (104) in series, in parallel, or a combination of in series and in parallel.

Creating a high quality and long lasting exercise machine with sufficient force and speed to be useful requires strong and reliable components. A simple mechanism for translating motor rotational torque into a cable resistance is to use an outrunner or hub motor (412) where the shaft is fixed and the outer body of the motor rotates and is designed as a spool (414) to directly wrap a cable to an actuator (114) around. To change the mechanical advantage of the system growing or shrinking the motor outer dimension is an option in this case. Similarly mounting a separate spool coaxially with the motor as shown later in FIG. 5B can be used as an alternate configuration that can also change the mechanical advantage.

For exercise machine usage, high precision motor control is optimal and control mechanisms like sensorless and hall effect control may not be sufficiently accurate to produce the correct resistance feel especially at low speeds. It is better to use a high precision motor encoder, for example 5000 ticks per rotation, to get an acceptable level of control. This type of encoder may be integrated on the shaft circumference or axially on the shaft or on the side shells of the motor. The encoder type may be optical, magnetic, inductive or capacitive. Direct mounting gives a benefit of a simple, quiet, precision mounting.

Spools and encoders may be mechanically coupled via belts, chains, gears or wheels, however this may be suboptimal for reliability, precision, cost and complexity and for the usage of the system it may create a noisier solution. It is possible to invert the above arrangement and achieve the same result by fixing the outer hub and having the shaft rotate and mount a cable spool and motor encoder on the shaft.

Exercise machines are generally designed to have a long usage lifetime however there may be some parts that wear earlier or are susceptible to damage outside the system. In this case simplifying the maintenance of the machine improves quick and easy serviceability. The arrangement above has minimal mechanical complexity and may be designed to enable easy user replacement of items like the cable. This may be simplified even further by easy to open panels, with safety lockouts to disable the machine if open, and even by mounting the motor (412) on a single side so it is easy to access and replace the cable.

Additional sensors may also be used. There is also benefit to integrating a torque sensor directly into the motor assembly as this can give an even more accurate and real-time feedback to be able to adjust the controls when a user makes sudden movements. Similarly for cable based exercise machines adding a direct tension sensor in the pulley system preferably as close to the user, wireless or wired, as possible allows detecting cable slack early and compensating in the motor control.

Figure 4B:
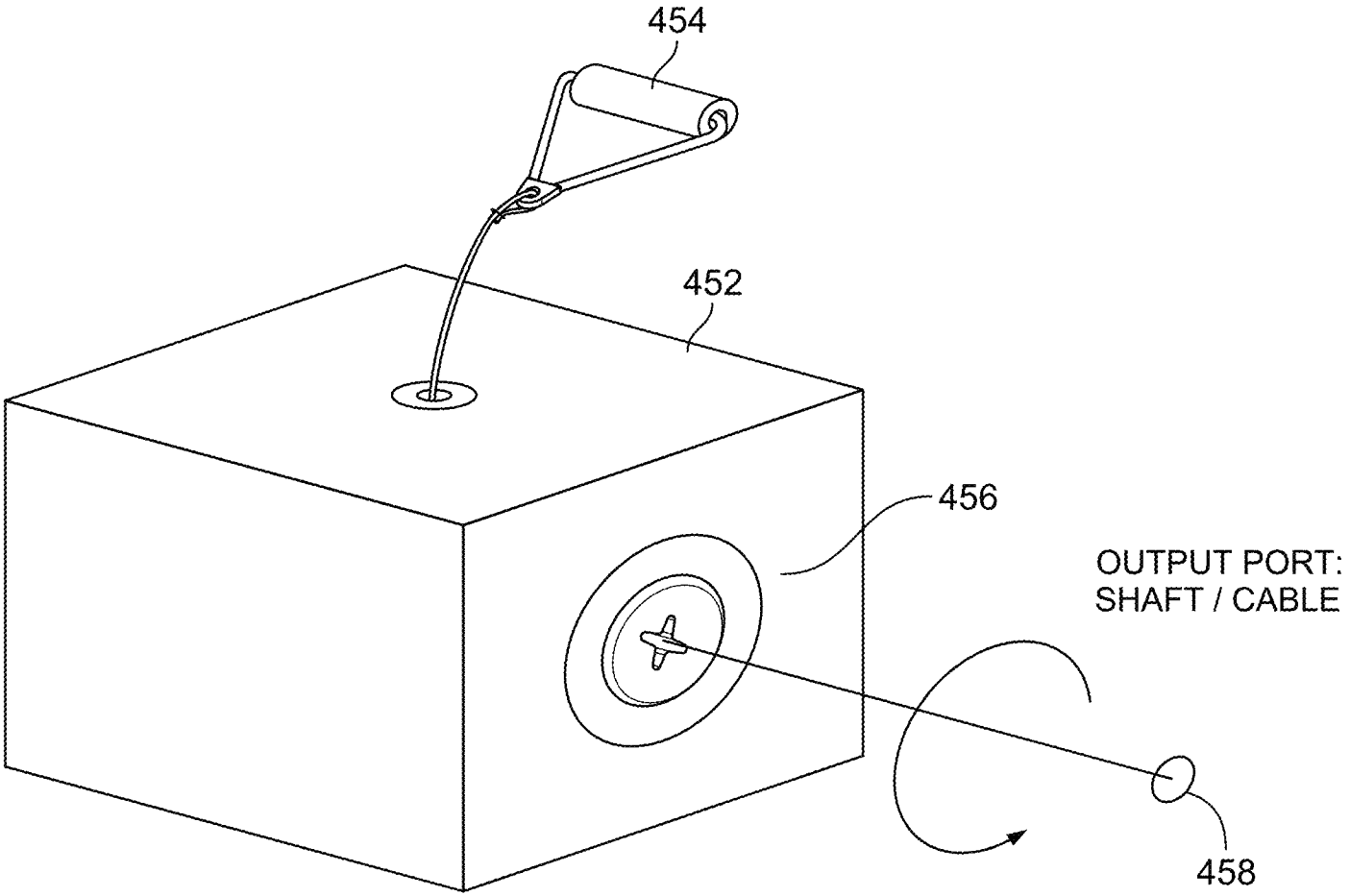
FIG. 4B is an illustration of a modular exercise module.

FIG. 4B is an illustration of a modular exercise module. The modular exercise module is also referred to herein as an "engine", as in an exercise engine. In one embodiment, the system of FIG. 4A depicts the fundamental system of the module in FIG. 4B shown in chassis (452). Chassis (452) is connected via the spool (414) and cable to actuator (114), here shown as a handle (454). The mechanical accessory/expansion port (416) is an output port (458) like a shaft or cable.

Multiple modules (452) may be combined to create a system with higher maximum resistance, and/or a system for exercising multiple limbs.

Figure 5A:
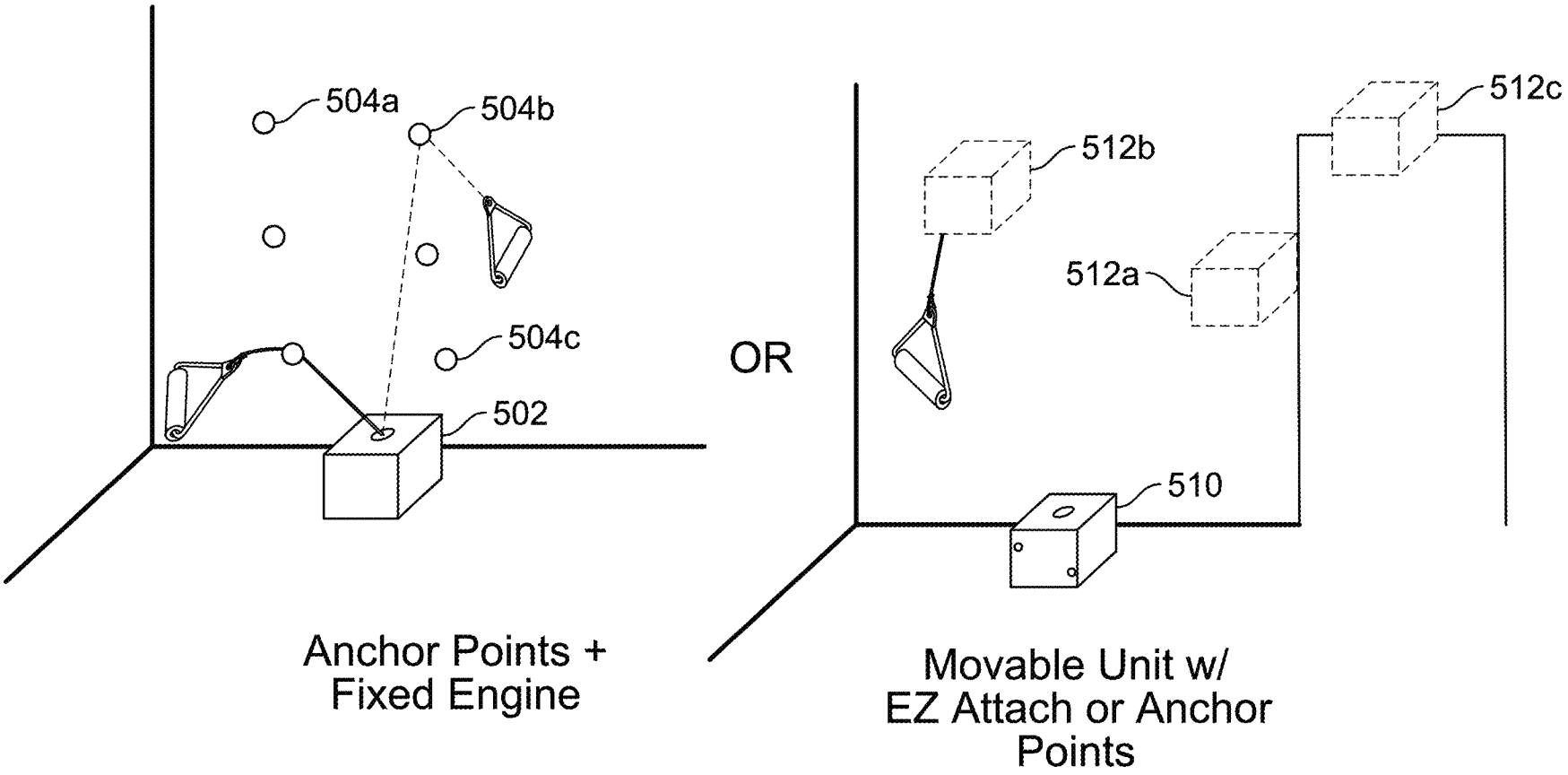
FIG. 5A is an illustration of two modular exercise module configurations.

FIG. 5A is an illustration of two modular exercise module configurations. In an "fixed engine" configuration the engine (502) is fixed in place and various anchor points are provided (504*a*, 504*b*, 504*c*) that allow a different origination point for an exercise actuator (114, 454). In a "movable unit" configuration the unit (510) is itself movable using an easy attach or anchor ports (512*a*, 512*b*, 512*c*), like the analogy of a "docking station" that securely fasten the engine (512) to an appropriate point on a wall or other fixture.

Figure 5B:
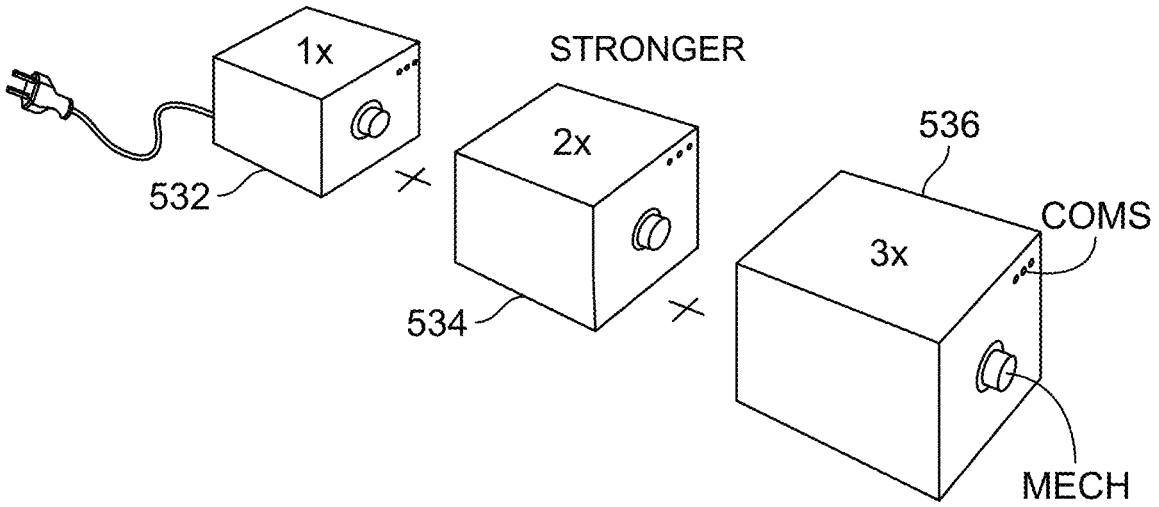
FIG. 5B is an illustration of two modular exercise module modes.
Figure 5B:
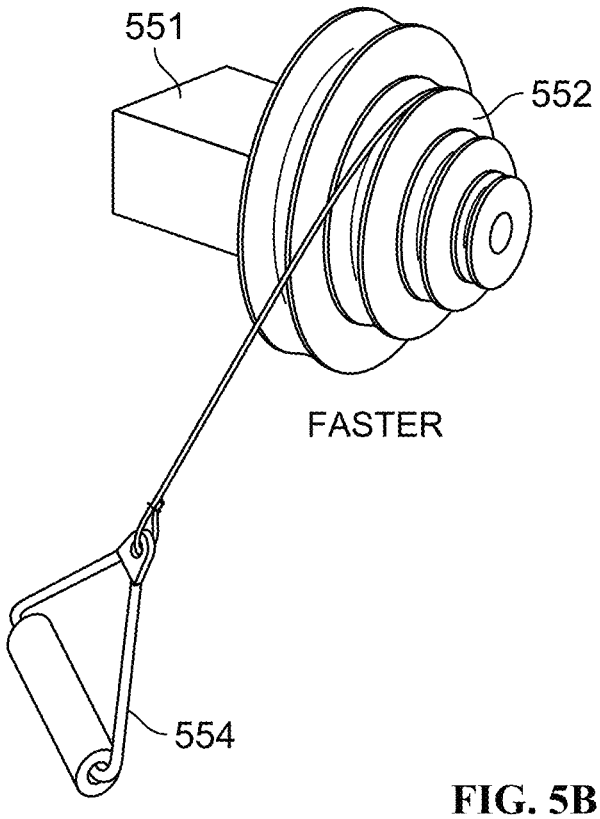

FIG. 5B is an illustration of two modular exercise module modes. In a "stronger" mode the engine (532) may be combined with a second engine (534) and optionally a third engine (536). As each engine (532, 534, 536) has its own power supply and motor, the resistance offered by a combined unit may be stronger than any one unit on its own. In order to effectively combine units, the engines are coupled both mechanically but also electronically so that they can communicate, for example, phase of the given unit's motor with relation to its stator. In a "faster" mode the unit (551) may be coupled to a clutch and/or series of gears or different circumference spools to trade off resistance offered with speed of the actuator (114, 454) using mechanical advantage.

Physical Reconfiguring. Each module (452) has one or more couplers capable of taking different kinds of attachments. The attachment port features a positive lock, ease of changeability, and a strength to exceed the maximum/rated torque of the module (452). A splined coupler is one example.

A simple attachment for a cable based exercise application is a spool (414) that attaches directly to the port and enables the cable to wrap around the spool. For a continuous motion exercise like a cycling or a treadmill type of machine it is usually easier to have a belt gear attachment.

A particular motor (412) inside an exercise module (452) has a specific torque, speed performance curve that it can provide. However it is possible for the user or integrator of the module to shift the torque speed curve by trading off one against the other with various mechanical advantage possibilities. One simple technique as shown in the "faster" mode is changing the spool for one of a larger diameter to increase maximum speed while reducing maximum force—which would tend to benefit high intensity exercise like cardio, while choosing a smaller spool would increase maximum force and reduce maximum speed—which would benefit strength training. A more complex system is available using a planetary gearing arrangement to allow more dynamic control of the mechanical advantage without physically switching out the attachment.

Figure 5C:
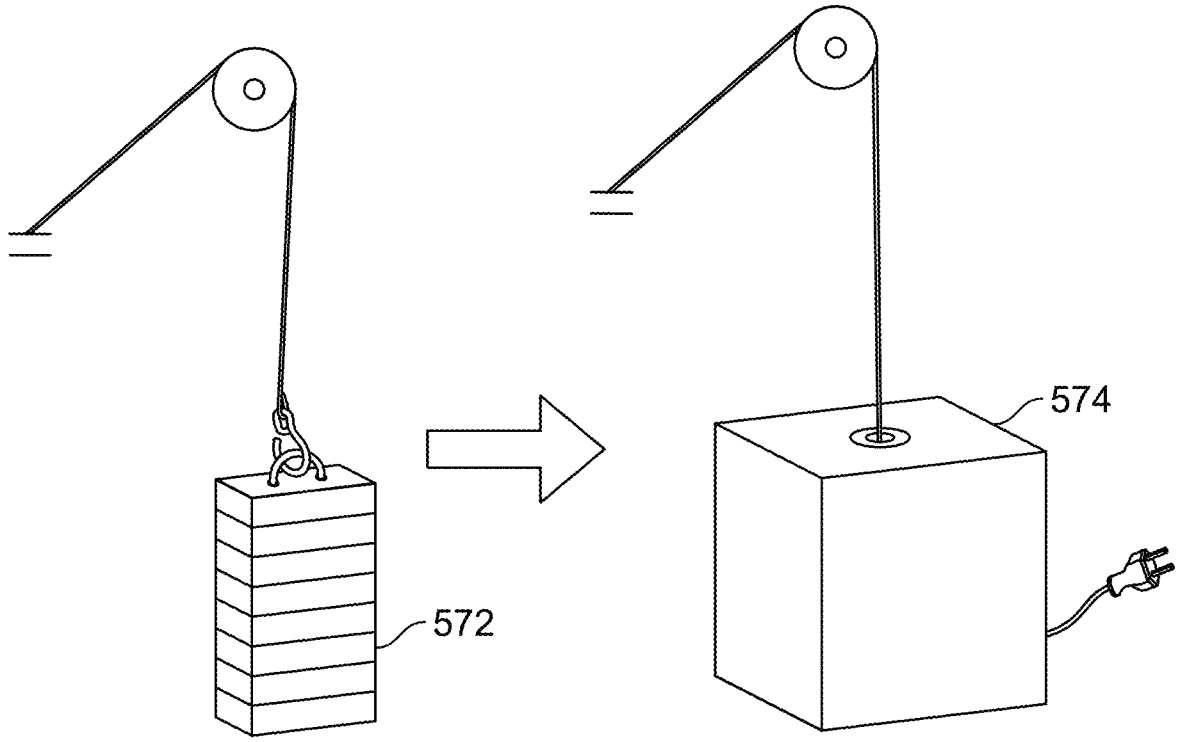
FIG. 5C is an illustration of a weight stack replacement using a modular exercise module.

FIG. 5C is an illustration of a weight stack replacement using a modular exercise module. A traditional weight stack (572) used in an exercise machine may be replaced directly using the modular engine (574) as shown in FIG. 5C.

This component may thus replace a weight stack in any existing gym weight machine or in a cardio machine. This system is a simplified core module in a box including a motor, motor controller, a spool or gear. Exiting the box is a mechanical attachment such as a cable, chain, belt, or shaft. The box requires AC power and may regenerate power and/or contain a battery. For control it has wired such as USB, and wireless such as Bluetooth/Wi-Fi options to enable control.

This box may be licensed to original equipment makers (OEM) who integrate this box into systems that they sell. This box may also be used directly to consumers. Consumers may use as many of these components as they prefer for adding additional maximum resistance, and/or multiple limb access. The multiple modules may be used to build up a more complete machine and/or custom machine.

The box implements torque control for workouts and generates data. In many cases OEM licensees do not have the technical background to host the cloud services for the data, so cloud based services are also provided to these licensees based on exercise data, for example aggregated exercise data, sent to an overarching organization before being shared with users and/or OEM licensees.

System Configuration. A user may use a tablet or phone with Wi-Fi and/or Bluetooth to control an engine (574). The user may install an app on their device, then the modular component (574) is paired through a UX pairing function. Pairing may be automatic or the component (574) may be paired using a pairing button like used in traditional Bluetooth systems. If Wi-Fi is used, a user process is used to put the modular component on a Wi-Fi network. Pairing through Bluetooth to pass the Wi-Fi information and/or credentials over Bluetooth is also a technique used. Once pairing is completed, the user's device configures the modular component (574) for exercise.

Two or more engines are combined physically to increase max resistance. As shown in FIG. 4B, each module (452) has at least one mechanical accessory port (456). A motor may have two mechanical accessory ports, one on either side of the motor. In one embodiment, to simplify motor mounting it is less complex to design around a motor with one side being fixed and the other side rotating and providing a single port (456). Each module (452) is capable of running in forward or reverse to simplify combing two modules together.

Multiple modular components are connected via Wi-Fi/Bluetooth or connected through another digital interface such as LVDS, USB, or UART for configuration and/or coordination. The electronic communication connection may be daisy-chained or put into a star configuration. For a wired configuration, one modular component may be master and that master may communicate wirelessly to the user's device.

Figure 6A:
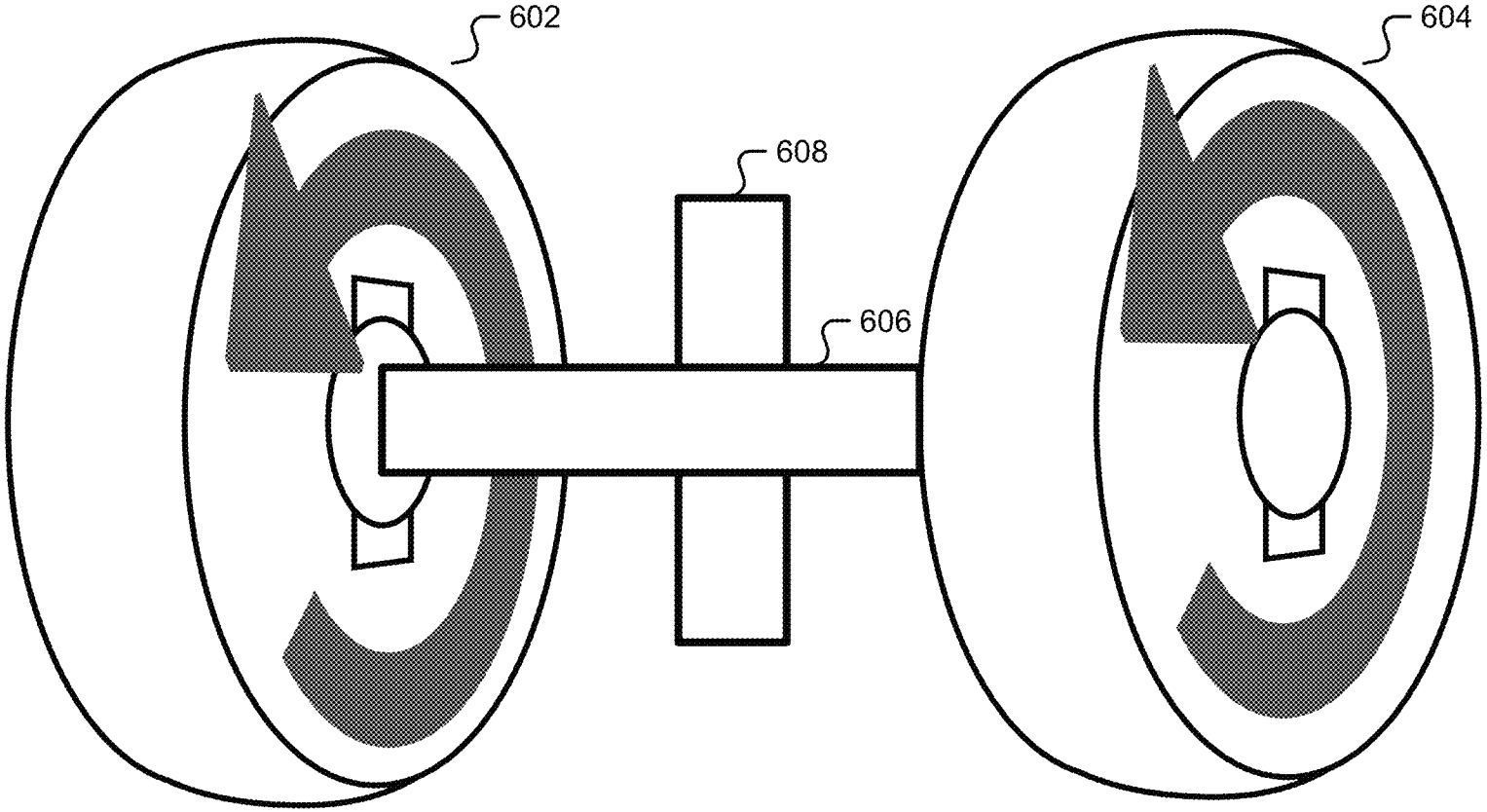
FIG. 6A is an illustration of a two modular exercise module direct coupling.

FIG. 6A is an illustration of a two modular exercise module direct coupling. The two engines (602) and (604) are reduced for clarity as a round drum object in FIG. 6A. A shaft (606) is directly coupled to the auxiliary/output port (458) to provide double the strength of resistance to a spool for an exercise application/actuator (608). Thus, to combine two modules (602, 604) a simple method is to use the drive shaft (606) with a single spool (608) on it and configure one of the modules (604) to run in reverse in order to double the torque the two modules (602, 604) together can generate.

Figure 6B:
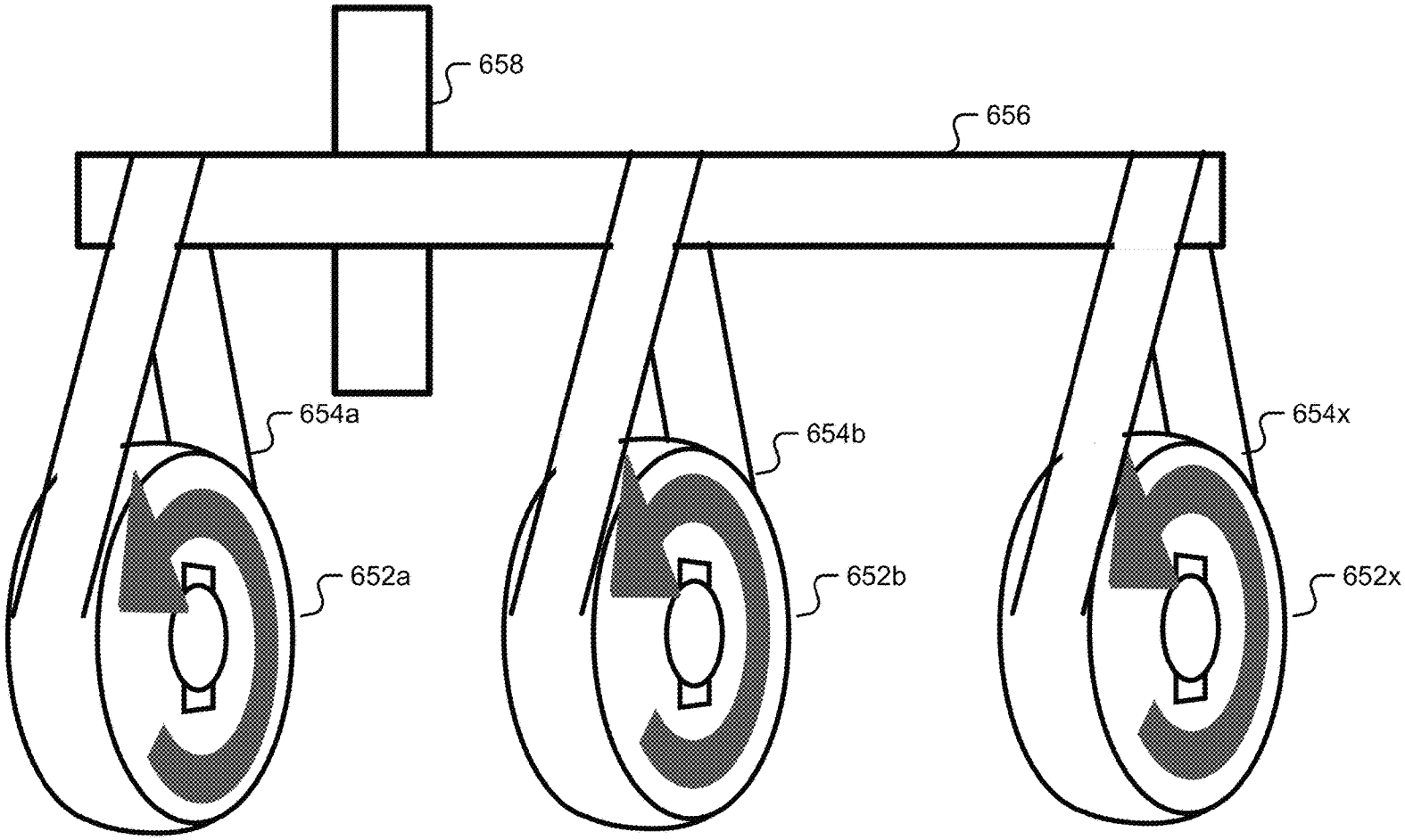
FIG. 6B is an illustration of a three modular exercise module indirect coupling.

FIG. 6B is an illustration of a three modular exercise module indirect coupling. Again, the three engines (652*a*, 652*b*, 652*c*) are reduced for clarity as a round drum object in FIG. 6B. A shaft (656) is driven by the three engines by way of three belts (654*a*, 654*b*, 654*c*) or other indirect coupling for each of the engines (652*a*, 652*b*, 652*c*, respectively.) The shaft (656) in turn drives an exercise application/actuator via a spool (658) with triple the torque generated and/or strength of resistance. The belt coupling shown in FIG. 6B may be extended to four or more engines.

Figure 6C:
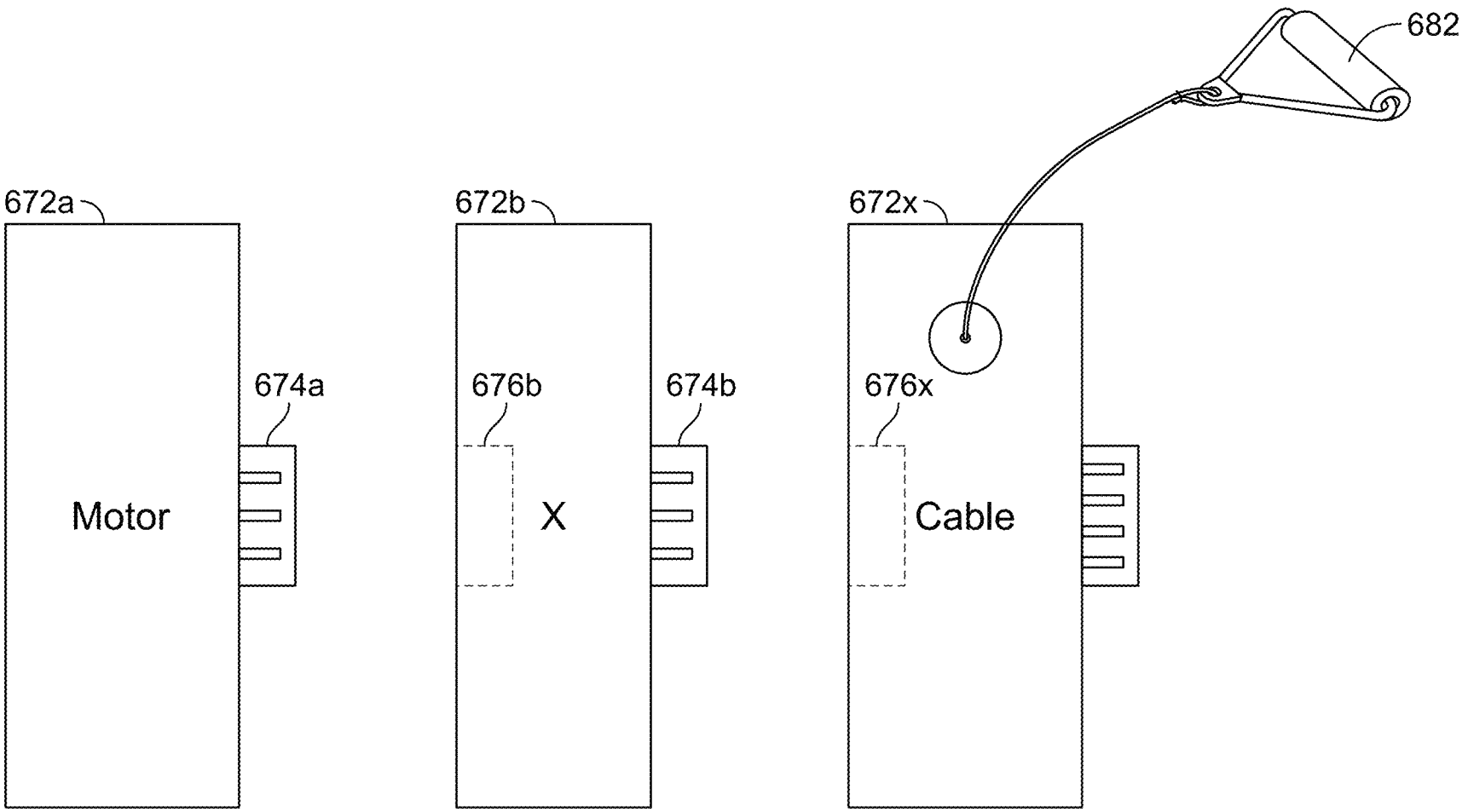
FIG. 6C is an illustration of a three modular exercise module direct coupling.

FIG. 6C is an illustration of a three modular exercise module direct coupling. For an engine (672*a*) a geared element (674*a*) for the output port (458) is designed to couple into a corresponding socket (676*b*) as an "input port" to a next engine (672*b*). Similarly, the engine (672*b*) may couple its geared element (674*b*) to an input port (676*x*) for a third engine (672*x*). This allow a modular stacking of engines, shown in FIG. 6C with three engines for clarity, and which may be extended to any engine count of two or greater.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine, comprising:

a first housing;

a central electromagnetic resistance unit;

a resistance mechanical interface comprising a spool and a cable configured to provide a force from the central electromagnetic resistance unit in response to a control interface that receives commands from an exercise actuator, wherein the cable extends out from a first side of the first housing; and a mechanical expansion port configured to link the first housing to a second housing via a mechanical attachment, wherein the mechanical expansion port is located at a second side of the first housing, wherein the second side of the first housing is adjacent to the first side of the first housing.

2. The exercise machine of claim 1, wherein the mechanical expansion port comprises a shaft, wherein the first housing is further configured to couple in parallel to at least two other housings via the shaft.

3. The exercise machine of claim 1, wherein the mechanical expansion portion comprises a shaft wherein the first housing is further configured to couple in series to the second housing via the shaft.

4. The exercise machine of claim 1, wherein the control interface is further configured to couple in parallel to a second control interface in the second housing.

5. The exercise machine of claim 1, wherein the control interface is further configured to couple in series to a second control interface in the second housing.

6. The exercise machine of claim 1, further comprising a monitor interface, wherein the monitor interface is configured to accommodate a standard video connection to a monitor.

7. The exercise machine of claim 6, wherein the standard video connection is an HDMI connection.

8. The exercise machine of claim 6, further comprising a monitor mechanical interface to support the monitor.

9. The exercise machine of claim 8, wherein the monitor mechanical interface is a rotating socket.

10. The exercise machine of claim 8, wherein the monitor mechanical interface can provide landscape orientation for video viewing and portrait orientation for exercise.

11. The exercise machine of claim 8, wherein the monitor mechanical interface exposes lateral arms in portrait mode.

12. The exercise machine of claim 8, wherein the lateral arms support the exercise actuator.

13. The exercise machine of claim 1, wherein the central electromagnetic resistance unit is a motor.

14. The exercise machine of claim 1, wherein the central electromagnetic resistance unit is two motors.

15. The exercise machine of claim 1, wherein the exercise actuator is a cardiovascular exercise actuator.

16. The exercise machine of claim 1, wherein the exercise actuator is a bike.

17. The exercise machine of claim 1, wherein the exercise actuator is a bike and associated with a front wheel of the bike.

18. The exercise machine of claim 1, wherein the exercise actuator is a bike and associated with pedals of the bike.

19. The exercise machine of claim 1, wherein the exercise actuator is a bar.

20. The exercise machine of claim 1, wherein the exercise actuator is a cable.

* * * * *